United States Patent [19]

Gaetano

[11] 4,406,451

[45] Sep. 27, 1983

[54] COLLAPSIBLE BIDIRECTIONAL JOGGING APPARATUS

[76] Inventor: Salvatore Gaetano, 130-16 115th St., South Ozone Park, N.Y. 11420

[21] Appl. No.: 275,812

[22] Filed: Jun. 22, 1981

Related U.S. Application Data

[63] Continuation-in-part of Ser. No. 972,669, Dec. 26, 1978, Pat. No. 4,274,625.

[51] Int. Cl.[3] ..... A63B 23/06

[52] U.S. Cl. ..... 272/69; 403/113

[58] Field of Search ..... 272/69, 70, 70.3, 70.4; 403/342, 113, 117

[56] References Cited

U.S. PATENT DOCUMENTS

| | | | |
|---|---|---|---|
| 100,665 | 3/1870 | Potter | 403/342 X |
| 152,476 | 6/1874 | Frizell | 403/113 |
| 759,296 | 5/1904 | Morairty | 272/69 |
| 897,722 | 9/1908 | Day | 272/69 |
| 931,394 | 8/1909 | Day | 272/69 |
| 1,064,968 | 6/1913 | Hagen | 272/69 |
| 1,082,940 | 12/1913 | Flora | 272/69 |
| 1,369,933 | 3/1921 | Nelson | 403/113 X |
| 1,869,060 | 7/1932 | Harter | 403/113 |
| 2,594,051 | 4/1952 | McFarland et al. | 272/70.4 |
| 3,193,287 | 7/1965 | Robinson | 272/69 |
| 3,606,320 | 9/1971 | Erwin, Jr. | 272/69 |
| 3,642,279 | 2/1972 | Cutter | 272/69 |
| 4,093,171 | 6/1978 | Mengo, Sr. | 403/113 X |
| 4,113,246 | 9/1978 | Gibbs | 272/69 |

FOREIGN PATENT DOCUMENTS

| | | | |
|---|---|---|---|
| 599549 | 7/1934 | Fed. Rep. of Germany | 272/69 |
| 11152 | of 1892 | United Kingdom | 272/69 |
| 225034 | 11/1924 | United Kingdom | 272/69 |
| 382340 | 10/1932 | United Kingdom | 272/69 |
| 405473 | 2/1934 | United Kingdom | 272/70 |

*Primary Examiner*—Robert A. Hafer
*Assistant Examiner*—Arnold W. Kramer

[57] ABSTRACT

A non motorized bidirectional jogging apparatus having a rectangular base member with a roller assembly formed on the base member. A level adjustment device is coupled to the base member in order to adjust the angular incline of the base member relative to the support surface. A collapsible frame extends upwardly from the base member. The collapsible frame consists of four upright posts hinged at their lower ends to the respective front and rear corners of the base member. Grasping rods axially extend from the front upright posts. A handlebar interconnects the top of the two rear upright posts. Side rails each respectively pivotally coupled to a front and rear upright post are each formed in two sections which are releasably coupled together so that on uncoupling, the frame can be folded flat. The hinges include stops to limit hinging of the posts between their upright and folded positions.

4 Claims, 6 Drawing Figures

FIG. 1
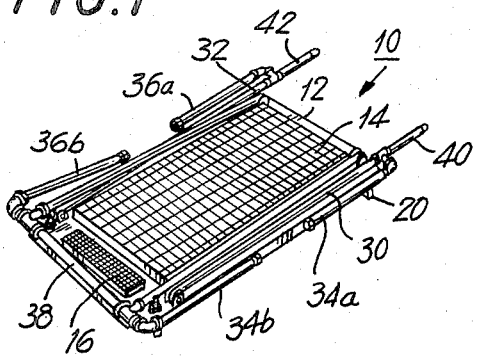
FIG. 2
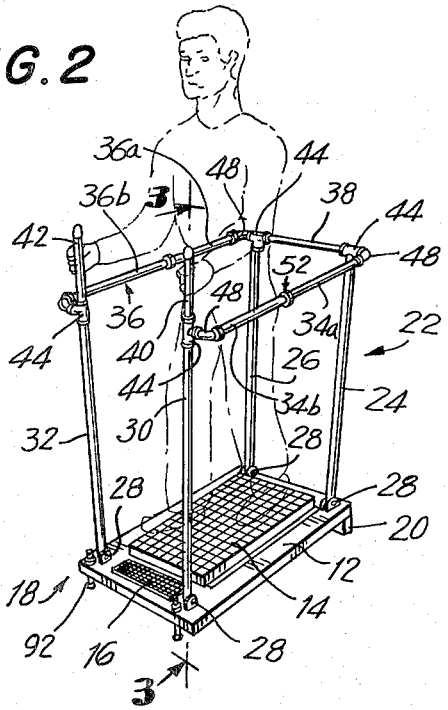
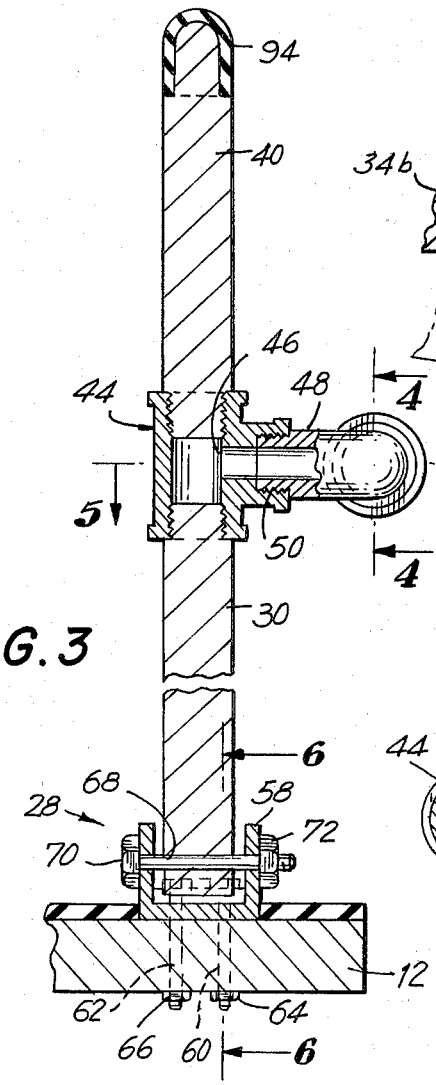
FIG. 3
FIG. 4
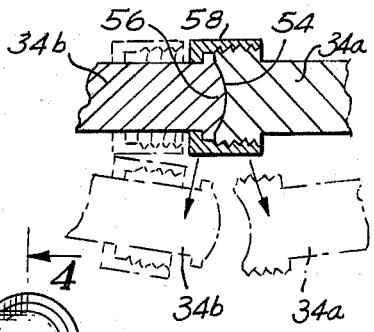
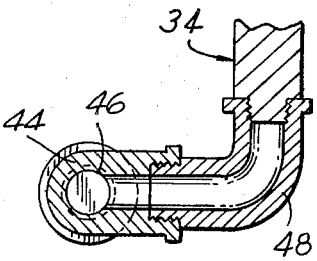
FIG. 5
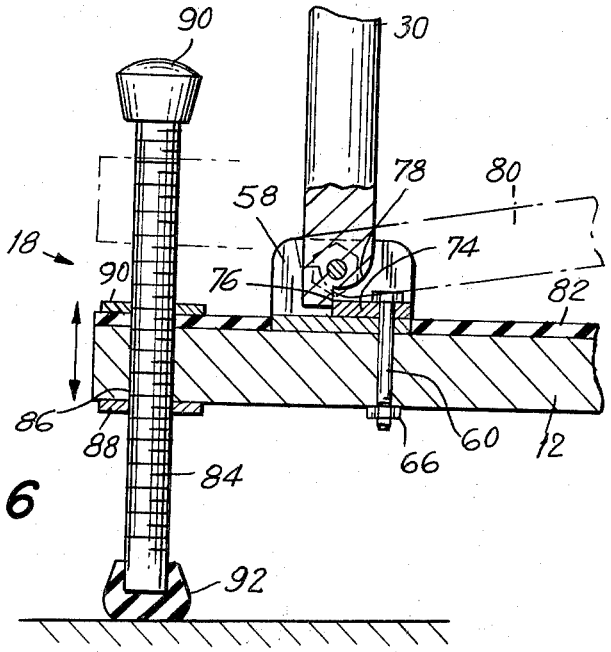
FIG. 6

COLLAPSIBLE BIDIRECTIONAL JOGGING APPARATUS

RELATIONSHIP TO OTHER APPLICATIONS

This application is a continuation-in-part application of copending Ser. No. 972,669 filed Dec. 26, 1978 for Exercising Apparatus and now U.S. Pat. No. 4,274,625.

BACKGROUND OF THE INVENTION

This invention relates to exercising devices, and more particularly to a non-motorized bidirectional jogging apparatus which can be collapsed for easy storage and erected for sturdy usage.

Exercising devices are commonly available for improving physical fitness as well as for cardiovascular purposes. One of the most popular type of exercisers is a jogging apparatus. The use of such indoor jogging apparatus avoids the necessity of having to jog outdoors with the numerous problems associated with such outdoor jogging, such as inclement weather, uneven ground, darkness, and dangerous environment. Some indoor jogging apparatus are of the motorized type including a treadmill or endless belt which is power driven. However, with a motorized treadmill, the user is forced to maintain the preset rate of acceleration. These devices are also costly, bulky, and prone to frequent breakdowns.

Other type of jogging apparatus available are of the non-motorized type. One such non-motorized jogging apparatus is described in the aforementioned parent application which teaches the use of a unique roller assembly placed on a rectangular base member. The base member includes level adjustment devices for adjusting the incline of the base member relative to a support surface. A frame upwardly extends from the base member. The roller assembly includes a series of parallel polished steel axles and a series of elongated support bars spacedly positioned from each other and being in perpendicular relationship with the axles. Aligned bores formed in the support bars rotatingly receive the axles therethrough. A pair of closely spaced rollers formed of hard rubber are located on each axle between adjacent support bars with the support bars being closely spaced to the rollers. The rollers are individually rotatable on the axles.

The frame includes four upright posts positioned at the four corners of the base member. Four horizontal rods peripherally interconnect the upright posts to thereby form a complete peripheral enclosure. Two of the horizontal rods are detachably connected to one side of the frame and pivotally fixed to the other side of the frame. The uprights are detachably coupled to the base member. When detached, the frame forms two side sections. When storing, the frame is removed from the base and these two frame sections together with the base form three sections which must be individually stored.

The aforementioned parent application also teaches a unique lubricating system having longitudinal channels formed along the top of each support bar with vertical openings downwardly extending from the top of each bar to the respective bores in that bar. Lubricating oil which is placed into the channel of the bar can flow therefrom to each bore in the bar and then along the axles to thereby lubricate the roller assembly.

The aforementioned parent application included other teachings. All of the parent application is hereinincorporated by reference.

The present invention provides improvements over the parent application by providing an improved collapsible arrangement whereby the frame itself can be folded directly onto the base member and thereby stored as one piece. The device is therefore extremely compact when stored and requires little room. Furthermore, all of the parts fold onto the base so that no separate sections need be stored independently of the base.

Additionally, because of the frame construction, the device is extremely sturdy in its erect position and accordingly provides improved and longer lasting usage. Additionally, by utilizing harder rubber for the rollers, there is increased rigidity so that the roller assembly is more effective and operates easier. Furthermore, it provides more reliable rotation and is longer lasting. Lubrication intervals are also reduced because of this improvement.

The present device can be easily utilized for bidirectional jogging. Because of the inclined base, in conjunction with the improved collapsible frame arrangement, and the unique roller assembly, the jogging apparatus can stimulate both uphill and downhill jogging resistance. When facing the raised end of the apparatus, the exercising simulates that of downhill resistance. When facing the lower end of the apparatus, the exercising simulates uphill jogging resistance. The amount of resistance can be suitably adjusted by means of adjustment to the angular incline of the base member.

SUMMARY OF THE INVENTION

Accordingly, it is an object of the present invention to provide an exercising apparatus which improves upon prior art devices.

Another object of the present invention is to provide a bidirectional jogging apparatus.

Still another object of the present invention is to provide a jogging apparatus which permits variations in the amount of exercising resistance provided.

Yet another object of the present invention is to provide a bidirectional jogging apparatus which simulates uphill resistance as well as downhill resistance.

A further object of the present invention is to provide an exercising device which permits walking, jogging, and the like and permits the user to adjust his speed of movement as he desires during the course of exercising routine.

Still another object of the present invention is to provide a jogging apparatus which permits the user to have a reduced amount of exercising resistance for an initial warmup period, turn around and achieve a greater amount of exercising resistance during the main portion of the exercise and, if desired, turn back to the original position to again have the reduced exercising resistance during a final cool down period.

A further object of the present invention is to provide a jogging apparatus which can be easily collapsed into a compact arrangement for reduced area storage.

Still another object of the present invention is to provide a jogging apparatus which can be easily collapsed without any tools, and which can be easily compacted for storage in a desirable location.

Another object of the present invention is to provide a jogging device which can be easily assembled and packaged in manufacturing, is sturdy, durable, easy to utilize and permits various types of exercising.

A further object of the present invention is to provide a method of achieving bidirectional jogging so as to achieve exercising which simulates downhill resistance as well as exercise which simulates uphill resistance.

Briefly, in accordance with the present invention, there is provided a non-motorized, bidirectional, jogging apparatus which includes a rectangular base member with a roller assembly formed on the base member. A level adjuster is coupled to the base member for adjusting the angular incline of the base member relative to a support surface. In this way, there is provided a simulated downhill jogging resistance when facing the raised end of the base member and a simulated uphill jogging resistance when facing the lower end of the base member. A collapsible frame upwardly extends from the base member and includes holding devices at both the raised and lower ends of the base member so that an individual can easily turn around and jog in either direction, as desired, so as to achieve simulated uphill jogging resistance or simulated downhill jogging resistance, depending upon the direction in which he faces.

The collapsible frame includes four upright posts hinged at their respective lower ends to the front and rear corners of the base member. Side rails are each pivotally interconnected to a respective front and rear upright post. A handle bar interconnects the two rear upright posts. At the front posts extension rods are connected to provide grasping. The side rails are split with releasable coupling devices interconnecting the split sections. In this way, by opening the side sections, the side sections will pivot so as to align with the uprights and the uprights can then be folded onto the base member for easy storage.

The present invention also contemplates a method of jogging on a non-motorized jogging apparatus having a roller assembly formed on a incline base member with handlebars upwardly extending from the base member. The method comprises facing the raised end of the inclined base while jogging in order to achieve exercising which simulates downhill resistance, then turning around so as to face the lower end of the inclined base while jogging in order to achieve exercising which simulates uphills resistance.

The foregoing objects, features and advantages of the invention will, in part, be pointed out with particularity, and will, in part, become obvious from the following more detailed description of the invention taken in conjunction with the accompanying drawings, which form an integral part thereof.

BRIEF DESCRIPTION OF THE DRAWINGS

In the drawings

FIG. 1 is a perspective view of the jogging apparatus in accordance with the present invention shown in a collapsed condition for storage;

FIG. 2 is a perspective view of the apparatus shown in an erected condition for use in bidirectional jogging;

FIG. 3 is a sectional view taken along line 3—3 of FIG. 2 and showing a portion of the frame structure;

FIG. 4 is a cross sectional view taken along lines 4—4 of FIG. 3 and showing the joining of the two sections of the side rails;

FIG. 5 is a cross sectional view taken along lines 5—5 of FIG. 3 and showing an elbow connection of the frame structure; and FIG. 6 is a cross sectional view taken along line 6—6 of FIG. 3 and showing the height adjusting mechanism as well as the hinging mechanism of the frame.

In the various figures of the drawing, like reference characters designate like parts.

DESCRIPTION OF THE PREFERRED EMBODIMENTS

Referring now to FIGS. 1 and 2, the present invention comprises an exercising apparatus shown generally at 10 including a substantially rectangular base member 12 on which is secured a roller assembly shown generally at 14. The roller assembly is of the type described in the aforementioned parent application. Specifically, it includes a series of parallel polished steel axles with a series of elongated suport bars spacedly positioned from each other and in perpendicular relationship with the axles. Aligned bores are formed in the support bars for rotatingly receiving the axles therethrough. A pair of closely spaced rollers formed of hard rubber are located on each axle between adjacent support bars with the support bars being closely spaced to the rollers. The rollers are individually rotatable on the axles.

In the present embodiment of the invention, the rollers as are shown in FIG. 7A and identified by the numbers 90 and 92 of the parent application, U.S. Pat. No. 4,274,625, are formed of 2-ply hard rubber which is formed of a very tough and thick material. This rubber has a more uniform internal diameter which reflects in a more dependable uniform rotation. Additionally, this rubber provides improved rigidity and easier and more reliable rotation with long lasting usage before applying lubrication.

The particular lubricating method of the roller assembly has also been described in the aforementioned parent application and includes longitudinal channels formed along the tops of each of the support bars with a vertical opening downwardly extending from the top of each bar to the respective bore in that bar.

Lubricating oil can then be placed into the channel of a bar and can flow therefrom to each bore in the bar and then along the axles to thereby lubricate the roller assembly.

A stationary tred 16 is placed at the front end of the base member 12. Level adjustment means, shown generally at 18 is included at the front end for varying the height of the front end relative to a support surface on which it rests. A fixed block 20 is placed at the rear end of the base member to raise it above the support surface.

Upwardly extending from the base member is a frame assembly, shown generally at 22 and including the two upright posts 24, 26 hingedly connected at the rear corners by means of the hinge mechanisms 28, which will be more fully explained hereinafter. At the front end are also provided two upright posts 30, 32 which are also pivotally connected by means of the hinge mechanisms 28 to the respective front corners of the base member 12. Side rails 34, 36 respectively interconnect the uprights 24, 30 and 26, 32. A cross bar 38 is placed at the rear and interconnects the uprights 24, 26 at the same time interconnecting the side rails 34, 36. Upwardly extending from the front upright 30 there is provided an extension rod 40 and a similar extension rod 42 extends upwardly from the upright post 32.

As can best be seen in FIGS. 2 and 3, the extension rod 40 is interconnected to the upright post 30 by means of a T-joint 44 by threading the two sections 40, 30 into the coaxially aligned internally threaded bore 46. The same T-section is used to interconnect to an elbow 48 which threads into the perpendicular bore 50 of the T-joint 44. The elbow 48 connects at its other end to the side rail 34, as can best be seen in FIG. 5.

A similar combination of T-joint and elbow is used at the other front section to interconnect the upright post 32 with the extension 42 and the side rail 36. At the rear sections, there is also provided a T-section 44 with an elbow 48. However, in this case the T-section is placed with its aligned bores interconnecting the cross bar 38 with the elbow 48. The perpendicular section of the T-joint 44 connects to the vertical upright post which extends from the base member.

As can best be seen in FIG. 2, each of the side rails 34, 36 are actually formed of two sections 34A and 34B on the one hand, and 36A, and 36B on the other hand. Each of the two sections are joined by means of a union 52 which can best be seen in FIG. 4. The union is a conventional one whereby the distal end of the section 34A includes the concave end 54 and the distal end of the section 34B includes the convex mating end 56. The two fit together and are held by means of the collar 58 which threads onto the two interconnected sections. As is shown in phantom, by loosening the collar 58, and moving it away from the junction, the two sections 34A, 34B can be disconnected and separated.

The lower ends of each of the uprights are interconnected in pivotal arrangement with the base member 12 by means of the hinge 28. Referring now to FIGS. 3 and 6, it will be noted that the hinge is formed of a U-shaped yoke 58 secured to the base member by means of the bolts 60, 62 which are held fastened by means of the nuts 64, 66 located beneath the base member 12. A bolt 68 having a hex head 70 passes through the legs of the yoke 58 and through a clearance hole in the lower end of the upright post 30 and is held in place by means of the nut 72 threaded at the other end of the yoke member. The upright will thus be able to pivot about the bolt 68.

In order to secure the upright posts in their vertically aligned position, an insert block 74 is positioned along the surface of the base member which extends from one end of the yoke to approximately the mid point of the yoke section. The bottom end of the upright post includes the diametric cut section 76 to form a shoulder which abuts against the insert block 74. The cut section of the upright post is then curved to form the cam surface 78 which can bend downward onto the insert block 74, as shown in phantom 80.

It should thus be appreciated, that the frame sections shown in FIG. 2 can be easily collapsed to form the compact arrangement shown in FIG. 1 for storing purposes or for transporting. The collapsing is achieved by unlocking the unions 52 which interconnect the two sections 34A, 34B and 36A, 36B of the side rails. The side rails will then pivot downward by means of the elbows 48 connected at the ends of each of these side sections. The sections of the side rails will then be aligned with the upright posts. The upright posts themselves, together with the aligned side sections can then be folded onto the base by means of the hinged mechanism 28 at the lower end of the posts. The posts will then lie on top of the base member in a compact position.

If desired, the extension rods 40, 42 can be unscrewed from their respective T-sections so as to avoid having any parts of the posts extending beyond the perimeters of the base member.

Referring now to FIG. 6, it will be noted that the base member can include a rubberized surface 82 along its top. There is also provided a level adjusting device 18 which can be used to raise or lower the front end of the apparatus. The level adjustment includes the threaded post 84 having a series of calibration lines which can be included on the post to judge the height of the post as it threads through a bore 86 in the front end of the base member 12. The steel plates 88, 90 can be placed above and below the adjusting post 84. Rubber stop 90 can be placed at the upper end of the post and a rubber foot 92 can be placed at the bottom end of the post.

By rotating the post into the bore, the front end of the base member can be raised and similarly by rotating it in the opposite direction, the front end can be lowered.

Normally, the front end of the apparatus will be lower than the rear end. In this way, the jogger entering onto the device from the front to the rear end will be facing the inclined rear end. By jogging while facing the upper incline, the jogger will feel a downhill resistance. It should be noted that when facing the rear end, the jogger can hold onto the cross bar 38 or the side rails 34, 36, depending upon the height of the jogger, the amount he bends over, and the desired resistance that he wants.

It should also be noted, that although the front end is open to permit the jogger to easily enter and leave the apparatus, at the same time there are provided handles in the form of the extension rods 40, 42 so that the jogger can hold onto the extensions and jog in the reverse direction. When standing in the reverse direction, namely facing the lower inclined end, the jogger will achieve a simulation of an uphill resistance. This is an increased resistance compared to what he achieved when facing the raised end.

Accordingly, because of the present device, a jogger can achieve a complete workout. He can initially face the raised end and achieve the equivalent of a downhill resistance. This can used during an initial warmup period. Then, the jogger can turn around and during the major portion of the exercise he will receive uphill resistance which will be greater than during the warmup period. After completing this major portion of the exercise, during a cool down period, the jogger can again aboutface and return to the position facing the raised end where he will again receive the reduced resistance simulating downhill resistance. The specific amount of resistance can be varied by varying the level adjustment. At the same time, should the jogger desire to jog on a horizontal level, he can raise the front end so that the base member will be substantially horizontal and provide the equivalent of jogging on a flat surface.

In order to facilitate the uphill and downhill resistance jogging, it should be noted that the upright posts at the rear end 24, 26 are higher than the posts 30, 32 at the front end. It has been found that this provides easier grasping of the various sections of the post during the jogging routine. At the same time, an individual who is shorter, may wish to reverse the entire level arrangement so that the front end will actually be higher than the rear end. In this way, a shorter individual will still find the proper parts of the posts to grasp for comfortable jogging.

The particular uprights can be formed of solid aluminum or other similar material. For convenience, a rubberized tip 94 can be placed at the upper end of the various rods 40, 42. Alternately, all of the posts and rods can be formed of regular pipe which is covered with aluminum tubing.

By means of the 2-ply hard rubber, and by providing the proper incline, a user can achieve almost automatic striding. All the jogger needs to do is to hold onto the bars and while striding, use his body to accelerate. A forward leaning body will increase the acceleration almost effortlessly while a more erect body will decrease acceleration with little effort on the part of the jogger. The use of the thicker and tougher 2-ply rubber lessens the pressure of the rollers on the axles and prevents squeezing of the rubber thereby allowing freer rotation. The internal diameter is allowed to maintain its dimension with hardly any distortion during actual usage.

It should also be appreciated, that by means of the particular unique frame structure, the entire device can be erected from a collapsed condition in an extremely short amount of time, without the use of any tools, and once erected is extremely sturdy and durable. This is of utmost importance during jogging whereby there is continuous pounding on the device and, if is not durable will tend to rotate, vibrate, and may in fact break during such vibration. The compactness of the device also permits easy packaging to the manufacturer.

A specific embodiment of the invention has been formed with a base member 33 inches by 19 inches and the roller assembly comprising a size of 12⅜ inches by 25 inches. There were included 31 rows of rollers, 8 sections to each roller assembly with two rollers in each section, thereby providing a total of 496 rollers. Six eye bolts were used to fasten the roller assembly to the base. Washers and nuts were used appropriately to tighten the eye bolts.

The rear uprights were 35 inches high and the front uprights were 33 inches high. The side rails included a front sections of 14½ inches and a rear sections of 13 inches joined by a union. The pipes were all ½ inch pipe covered with ¾ inch aluminum tubing. Standard ½ inch T's and street elbows were utilized.

There has been disclosed heretofore the best embodiments of the invention presently contemplated. However, it is to be understood that various changes and modifications may be made thereto without departing from the spirit of the invention.

I claim:

1. A non-motorized, bidirectional jogging apparatus, comprising:

an elongated base member;

a roller assembly formed onto said base member;

level adjustment means coupled to said base member for adjusting said angular incline of said base member relative to a support surface for providing a simulated downhill jogging resistance when facing one end of the base member and for providing a simulated uphill jogging resistance when facing the other end of the base member, a collapsible frame extends upwardly from said base member said frame comprising four upright posts each approximately the length of said base member and hinged at their lower ends to the respective front and rear corners of said base member, side rails each respectively pivotally coupled to and interconnecting a corresponding front and rear upright post, a handlebar interconnecting the two rear upright posts, and grasping rods axially extending from the front upright posts, said front upright posts not being interconnected to each other, whereby a user can enter onto the roller assembly between the front posts and can still jog facing towards the front as well as toward the rear of the apparatus by just turning around, and wherein said side rails are each formed in two sections, and further comprising coupling means on each side rail for releasably connecting the two sections of that side rail when said upright posts are in their upstanding position, and in the collapsed condition said upright posts longitudinally lying onto said base member with the sections of the side rails adjacent thereto, so as to form a unitary collapsed assembly.

2. A jogging apparatus as in claim 1, wherein said grasping rods are removable from said upright posts.

3. A jogging apparatus as in claim 1 the hinge means coupling said upright posts to their respective corners of said base member, further comprising stop means within said hinge means for limiting the pivotal movement of said uprights to a collapsed position and an upright position.

4. A jogging apparatus as in claim 1 wherein said roller assembly comprises a series of polished steel axles, a series of elongated support bars spacedly positioned from each other and being in perpendicular relationship with said axles, aligned bores formed in said support bars for rotatingly receiving said axles therethrough and a pair of closely spaced rollers formed of hard two-ply rubber located on each axle between adjacent support bars with the support bars being closely spaced to the rollers, the rollers being individually rotatable on the axles.

* * * * *